US005338656A

United States Patent [19]

Ikegawa et al.

[11] Patent Number: 5,338,656

[45] Date of Patent: Aug. 16, 1994

[54] SILVER HALIDE PHOTOGRAPHIC MATERIAL

[75] Inventors: Akihiko Ikegawa; Yuji Mihara; Masaki Okazaki, all of Kanagawa, Japan

[73] Assignee: Fuji Photo Film Co., Ltd., Kanagawa, Japan

[21] Appl. No.: 49,428

[22] Filed: Apr. 21, 1993

[51] Int. Cl.[5] ..... G03C 1/12

[52] U.S. Cl. ..... 430/577; 430/584; 430/585; 430/587

[58] Field of Search ..... 430/577, 587, 584, 585

[56] References Cited

U.S. PATENT DOCUMENTS 3,152,673 8/1973 Depoorter et al. ..... 430/567
3,705,038 12/1972 Philippaerts et al. ..... 430/567

FOREIGN PATENT DOCUMENTS 1333013 10/1973 United Kingdom .

*Primary Examiner*—Thorl Chea
*Attorney, Agent, or Firm*—Sughrue, Mion, Zinn, Macpeak & Seas

[57] ABSTRACT

Disclosed is a silver halide photographic material comprising at least one compound (merocyanine dye) represented by the following general formula (I):

(I)

wherein Z represents nonmetal atoms necessary to complete a 5- or 6-membered heterocyclic ring; X represents non-metal atoms necessary to complete a 5- or 6-membered acidic nucleus; $R^2$ represents $-(CH_2)_r-CONHSO_2-R^3$, $-(CH_2)_s-SO_2NHCO-R^4$, $-(CH_2)_t-CONHCO-R^5$ or $-(CH_2)_u-SO_2NHSO_2-R^6$; $R^3$, $R^4$, $R^5$ and $R^6$ each represent an alkyl group, an alkoxy group or an amino group; r, s, t and u each represent an integer from 1 to 5; $R^1$ has the same meaning as $R^2$ or represents an alkyl group substituted by a sulfo or carboxyl group; p represents 0 or 1; $L_1$ and $L_2$ each represent a methine group; and n represents 0, 1, 2 or 3.

9 Claims, No Drawings

SILVER HALIDE PHOTOGRAPHIC MATERIAL

FIELD OF THE INVENTION

The present invention relates to a silver halide photographic material which has reduced residual color upon development-processing and which offers improved sensitivity.

BACKGROUND OF THE INVENTION

Because of the recent trend toward rapid processing and the use of sensitizing dyes in large amounts, it is important to prevent silver halide photographic materials from being contaminated with sensitizing dyes remaining therein after processing (i.e., suffering from so-called residual color).

Hitherto, the sensitizing dyes disclosed in JP-B-51-1126 (the term "JP-B" as used herein means an "examined Japanese patent publication"), JP-B-51-4105, British Patent 1,333,013 and so on have been proposed because they cause less residual color. However, such dyes cannot achieve a satisfactory result when both slight residual color and high sensitivity are required.

SUMMARY OF THE INVENTION

Therefore, an object of the present invention is to provide a silver halide photographic material which has both high sensitivity and slight residual color upon development.

This and other objects of the present invention are attained with a silver halide photographic material which contains at least one compound (merocyanine dye) represented by the following general formula (I):

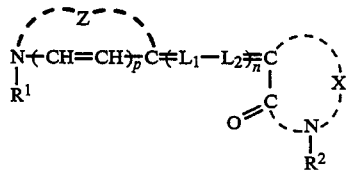

(I)

wherein Z represents nonmetal atoms necessary to complete a 5- or 6-membered heterocyclic ring; X represents non-metal atoms necessary to complete a 5- or 6-membered acidic nucleus; $R^2$ represents $-(CH_2)_r-CONHSO_2-R^3$, $-(CH_2)_sSO_2NHCO-R^4$, $-(CH_2)_t-CONHCO-R^5$ or $-(CH_2)_u-SO_2NHSO_2-R^6$; $R^3$, $R^4$, $R^5$ and $R^6$ each represent an alkyl group, an alkoxy group or an amino group; r, s, t and u each represent an integer from 1 to 5; $R^1$ has the same meaning as $R^2$ or represents an alkyl group substituted by a sulfo or carboxyl group; p represents 0 or 1; $L_1$ and $L_2$ each represent a methine group; and n represents 0, 1, 2 or 3.

DETAILED DESCRIPTION OF THE INVENTION

The compounds represented by general formula (I) are described below in detail.

The alkyl group represented by $R^3$, $R^4$, $R^5$ or $R^6$ may be substituted, and it is preferably one which contains 1 to 4 carbon atoms, especially a methyl, ethyl, hydroxyalkyl or aminoethyl group. The alkoxy group represented by $R^3$, $R^4$, $R^5$ or $R^6$ may be substituted, and it is preferably one which contains 1 to 4 carbon atoms, especially a methoxy, ethoxy, methoxyethoxy or hydroxyethoxy group. Substituents for these alkyl or alkoxy groups includes, for example, a hydroxy group, an alkyl group, an alkoxy group, an amino group, an alkoxycarbonyl group, a carbamoyl group, a sulfonyl group, and a sulfamoyl group. The amino group represented by $R^3$, $R^4$, $R^5$ or $R^6$ may be substituted by an alkyl group, a hydroxyalkyl group, an alkoxyalkyl group or so on, and two substituents attached thereto may form a ring. As the amino group, those containing 1 to 8 carbon atoms are preferred. In particular, methylamino, dimethylamino, ethylamino, diethylamino, hydroxyethylamino, morpholino and pyrrolidino are preferred over others.

In the group represented by $R^2$, the hydrogen atom attached to the nitrogen atom adjacent to the carbonyl or sulfonyl group is dissociable, so that $R^2$ can have the form of $-(CH_2)_r-CON^-SO_2-R^3$, $-(CH_2)_s-SO_2N^--CO-R^4$, $-(CH_2)_t-CON^-CO-R^5$ or $-(CH_2)_u-SO_2N^-SO_2-R^6$ in the presence of a base or the like.

As the alkyl group substituted by a sulfo or carboxyl group represented by $R^1$, those containing 1 to 5 carbon atoms are preferable. In particular, 2-sulfoethyl, 3-sulfopropyl, 4-sulfobutyl, 3-sulfobutyl, carboxymethyl, 2-carboxyethyl and 3-carboxybutyl groups are preferred over others. These substituted alkyl group may be further substituted, for example, by a hydroxy group, an alkoxy group, and an amino group.

As r, s, t and u, it is desirable that each be 1, 2 or 3.

As the 5- or 6-membered heterocyclic nucleus completed by Z, suitable examples thereof include thiazole nuclei {such as thiazole nuclei (e.g., thiazole, 4-methylthiazole, 4-phenylthiazole, 4,5-dimethylthiazole, 4,5-diphenylthiazole), benzothiazole nuclei (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, 4-phenylbenzothiazole) and naphthothiazole nuclei (e.g., naphtho[2,1-d]thiazole, naphtho-[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole)}, thiazoline nuclei (such as thiazoline, 4-methylthiazoline and 4-nitrothiazoline), oxazole nuclei {such as oxazole nuclei (e.g., oxazole, 4-methyloxazole, 4-nitrooxazole, 5-methyloxazole, 4-phenyloxazole, 4,5-diphenyloxazole, 4-ethyloxazole), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole) and naphthoxazole nuclei (e.g., naphtho[2,1-d]oxazole, naphtho[1,2-d]oxazole, naphtho[2,3-d]oxazole, 5-nitro-naphtho[2,1-d]oxazole)}, oxazoline nuclei (such as 4,4-dimethyloxazoline), selenazole nuclei {such as selenazole nuclei (e.g., 4-methylselenazole, 4-nitroselenazole, 4-phenyl-selenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole) and naphthoselenazole nuclei (e.g., naphtho[2,1-d]selenazole, naphtho[1,2-d]selenazole)}, selenazoline nuclei (such as selenazoline and 4-methylselenazoline), tellurazole nuclei (such as tellurazole nuclei (e.g., tellurazole, 4-methyltellurazole, 4-phenyltellurazole), benzotellurazole nuclei (e.g., benzotellurazole, 5-chlorobenzotellurazole, 5-methylbenzotellurazole, 5,6-dimethylbenzotellurazole, 6-methoxybenzotellurazole) and naphthotellurazole nuclei (e.g., naphtho[2,1-d]tellurazole, naphtho[1,2-d]tellurazole)}, tellurazoline nuclei (such as tellurazoline and 4-methyltellurazoline), 3,3-dialkylindolenine nuclei (such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine), 3,3,5-trimethylindolenine and 3,3-dimethyl-5-chloroindolenine), imidazole nuclei {such as imidazole nuclei (e.g., 1-alkylimidazoles, 1-alkyl-4-phenylimidazoles, 1-arylimidazoles), benzimidazole nuclei (e.g., 1-alkylbenzimidazoles, 1-alkyl-5-chlorobenzimidazoles, 1-alkyl-5,6-dichlorobenzimidazoles, 1-alkyl-5-methoxybenzimidazoles, 1-alkyl-5-cyanobenzimidazoles, 1-alkyl-5-fluorobenzimidazoles, 1-alkyl-5-trifluoromethylbenzimidazoles, 1-alkyl-6-chloro-5-cyanobenzimidazoles, 1-alkyl-6-chloro-5-trifluoromethylbenzimidazoles, 1-allyl-5,6-dichlorobenzimidazoles, 1-allyl-5-chlorobenzimidazoles, 1-arylbenzimidazoles, 1-aryl-5-chlorobenzimidazoles, 1-aryl-5,6-dichlorobenzimidazoles, 1-aryl-5-methoxybenzimidazoles, 1-aryl-5-cyanobenzimidazoles) and naphthimidazole nuclei (e.g., alkylnaphtho[1,2-d]imidazoles, 1-arylnaphtho[2,1-d]imidazoles); wherein the foregoing alkyl groups are preferably those containing 1 to 8 carbon atoms, including unsubstituted ones, such as methyl, ethyl, propyl, isopropyl, butyl, etc., and those substituted by a hydroxyl group, such as 2-hydroxyethyl, 3-hydroxypropyl, etc., of which methyl and ethyl groups are favored in particular; the foregoing aryl groups include a phenyl group, halogen (e.g., chlorine) substituted phenyl groups, alkyl (e.g., methyl) substituted phenyl groups and alkoxy (e.g., methoxy) substituted phenyl groups}, pyridine nuclei (such as 2-pyridine, 4-pyridine, 5-methyl-2-pyridine and 3-methyl-4-pyridine), quinoline nuclei {such as quinoline nuclei (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline) and isoquinoline nuclei (e.g., 6-nitro-1-isoquinoline, 3,4-dihydro-1-isoquinoline, 6-nitro-3-isoquinoline)}, imidazo[4,5-b]quinoxaline nuclei (such as 1,3-diethylimidazo[4,5-b]quinoxaline and 6-chloro-1,3-diallylimidazo[4,5-b]quinoxaline), oxadiazole nuclei, thiadiazole nuclei, tetrazole nuclei, pyrimidine nuclei and pyrroline nuclei.

Of these heterocyclic nuclei, thiazole, benzothiazole, naphthothiazole, oxazole, benzoxazole, naphthoxazole, benzimidazole, naphthimidazole, quinoline, pyrroline, thiazoline and tetrazole nuclei are preferred in particular.

X represents atoms necessary to complete a 5- or 6-membered acidic nucleus, and the term "acidic nucleus" used herein is the same as defined, e.g., in T. H. James, *The Theory of the Photographic Process,* 4th Ed., p. 198, Macmillan (1977).

Specifically, the aforementioned nucleus includes those disclosed in U.S. Pat. Nos. 3,567,719, 3,575,869, 3,804,634, 3,837,862, 4,002,480 and 4,925,777, and JP-A-3-167546 (the term "JP-A" as used herein means an "unexamined published Japanese patent application").

More specifically, 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,4-dione, isooxazoline-5-one, 2-thiazoline-4-one, thiazolidine-4-one, thiazolidine-2,4-dione, rhodanine, thiazolidine-2,4-dithione, isorhodanine, indoline-2-one, indoline-3-one, indazoline-3-one, 2-oxoindazolinium, 3-oxoindazolinium, 5,7-dioxo-6,7-dihydrothiazolo[3,2-a]pyrimidine, 3,4-dihydroisoquinoline-4-one, barbituric acid, 2-thiobarbituric acid, indazoline-2-one and pyrido[1,2-a]pyrimidine-1,3-dione are preferred examples of the acidic nucleus.

Of these nuclei, rhodanine, hydantoin, 2- or 4-thiohydantoin, 2-oxazoline-5-one, 2-thiooxazolidine-2,4-dione, barbituric acid, 2-thiobarbituric acid and 2-pyrazoline-4-one are more preferred over the others.

The methine group represented by $L_1$ or $L_2$ may be substituted by an optionally substituted alkyl group (e.g., methyl, ethyl, 2-carboxyethyl), an optionally substituted aryl group (e.g., phenyl, o-carboxyphenyl), a halogen atom (e.g., chlorine, bromine), an alkoxy group (e.g., methoxy, ethoxy), an alkylthio group (e.g., methylthio, ethylthio) or so on. On the other hand, it may combine with another methine group to complete a ring, or can also form a ring by combining with an auxochrome.

Specific examples of the compound represented by general formula (I) are illustrated below. However, the invention should not be construed as being limited to these compounds.

I-1

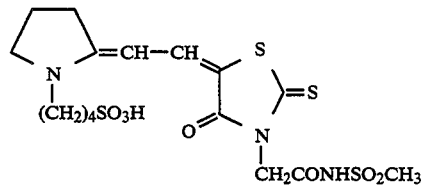

-continued
I-2
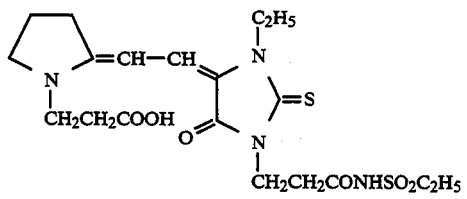
I-3
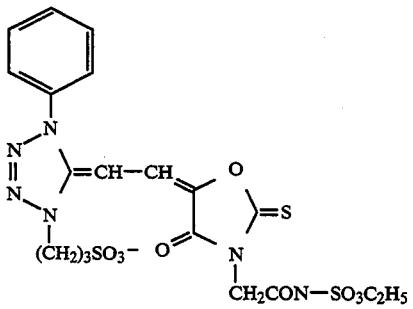
I-4
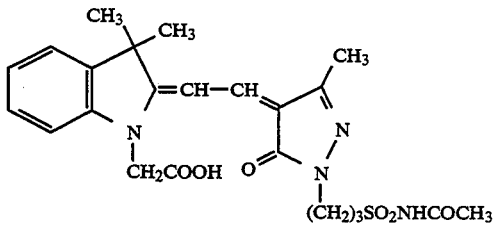
I-5
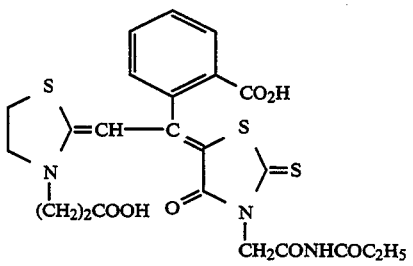
I-6
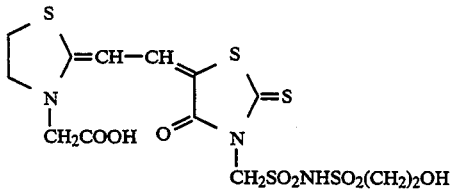
I-7
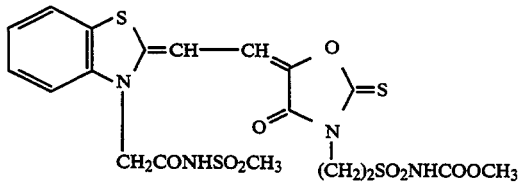
I-8
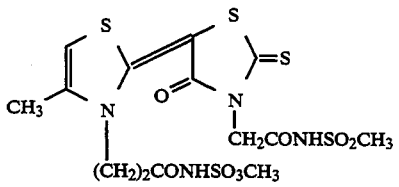

-continued
I-9
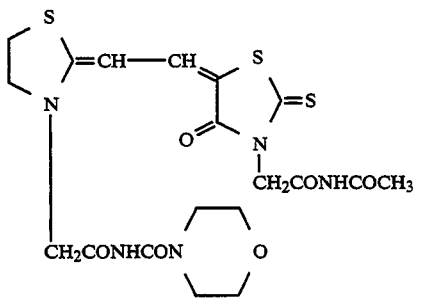
I-10
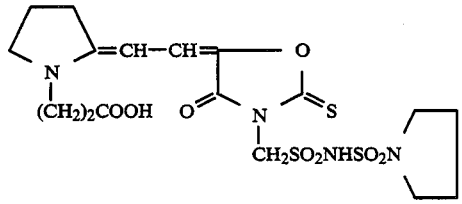
I-11
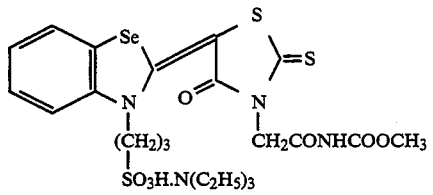
I-12
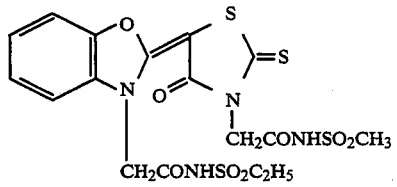
I-13
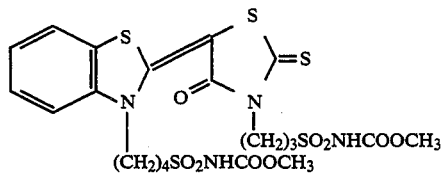
I-14
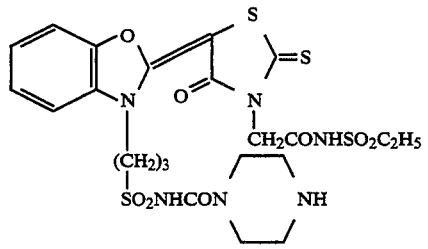
I-15
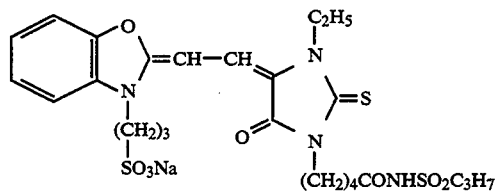

-continued

I-16

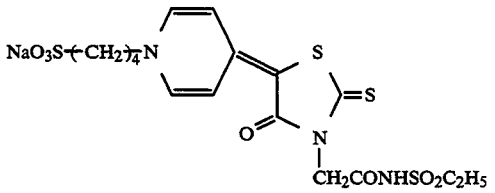

I-17

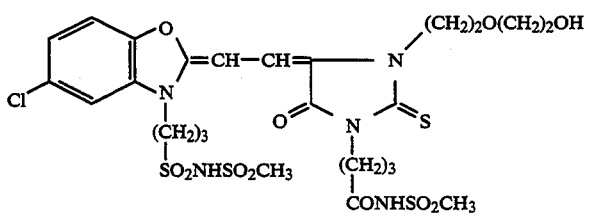

I-18

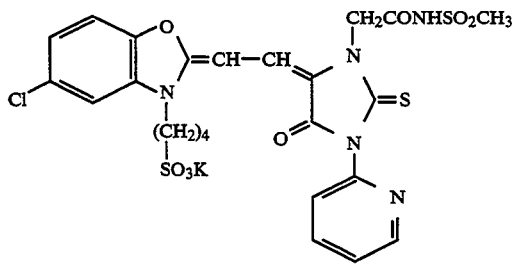

I-19

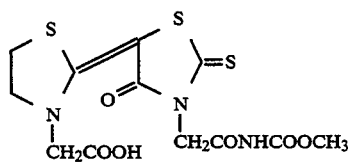

I-20

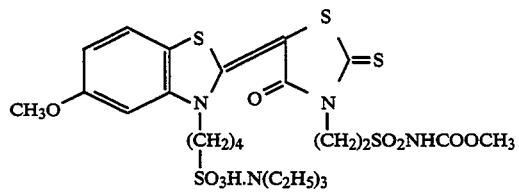

I-21

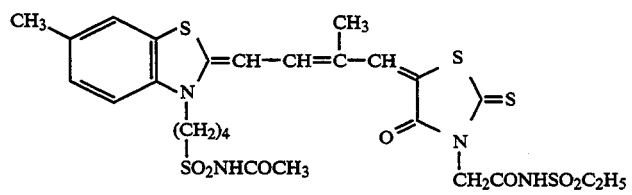

I-22

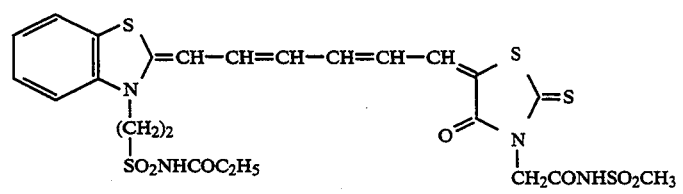

The compounds of the present invention, which are represented by the foregoing general formula (I), can be synthesized according to various methods.

Specific examples of such methods include those described, e.g., in F. M. Hamer, *Heterocyclic Compounds—Cyanine Dyes and Related Compounds*, John Wiley & Sons Co., New York and London (1964); D. M. Sturmer, *Heterocyclic Compounds—Special topics in heterocyclic chemistry-*, chapter 18, paragraph 14, pages 482 to 515, John Wiley & Sons Co., New York and London (1977); *Rodd's Chemistry of Carbon Compounds*, chapter 15, pages 369 to 422 (2nd Ed. vol. IV, part B, published in 1977) or chapter 15, pages 267 to 296 (2nd Ed. vol. IV, part B, published in 1985), Elsvier Science Publishing Company Inc., New York; and so on.

The compounds of general formula (I) can be dispersed directly into an emulsion, or can be added to an emulsion in a condition such that they are dissolved in an appropriate solvent (e.g., methyl alcohol, ethyl alcohol, methyl cellosolve, water or a mixture of two or more thereof). Also, in analogy with conventional sensitizing dyes, they can be added to an emulsion in a condition such that they are dispersed in a solution or colloid. On the other hand, they can be dispersed into an emulsion in accordance with the method disclosed in JP-A-50-80119.

The amount of the compound represented by formula (I) is used in the range of from about 1 to 2000 mg, preferably about 10 to 1000 mg per 1 kg of the emulsion used.

The silver halide which can be used in the present invention may include any of silver chloride, silver bromide, silver iodide, silver chlorobromide, silver chloroiodide, silver iodobromide, and silver chloroiodobromide.

Suitable methods for reacting a water-soluble silver salt with a water-soluble halide to make the silver halide include, e.g., a single jet method, a double jet method, or a combination thereof.

Also, a method in which silver halide grains are produced in the presence of excess silver ion (i.e., the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

In forming silver halide grains used in the present invention, ammonia, potassium cyanide, ammonium cyanide, thioether compounds (e.g., those disclosed in U.S. Pat. Nos. 3,271,157, 3,574,628, 3,704,130, 4,297,439 and 4,276,374), thione compounds (e.g., those disclosed in JP-A-53-144319, JP-A-53-82408 and JP-A-55-77737), amine compounds (e.g., those disclosed in JP-A-54-100717) or so on can be used as a silver halide solvent in order to control the grain growth.

The silver halide grains used in the present invention may have a regular crystal form, such as that of a cube, an octahedron or a tetradecahedron; an irregular crystal form, such as that of a sphere, a plate or so on; a crystal form having crystal defects such as a twin crystal plane; or a composite form thereof.

The average size of the silver halide grains is preferably no greater than 1.0 μm, particularly no greater than 0.7 μm. The method for determining the average grain size is described in detail in C. E. Mees & T. H. James, *The Theory of the Photographic Process,* 3rd ed., pages 36 to 43, Macmillan (1966).

The present invention can be employed in various kinds of photographic materials. Specific examples of such photographic materials include color negative films for amateur or motion picture use, color reversal films for slide or television use, color paper, color positive films, and color reversal paper. Also, it can produce desirable effects even when the present invention is employed as a black-and-white photographic material, an X-ray sensitive material, a photographic material for printing.

It is desirable in the present invention to use a water-soluble rhodium salt, such as rhodium chloride, rhodium trichloride, rhodium ammonium chloride or so on. Such a rhodium salt can also be used in the form of complex salt. The time to add the foregoing rhodium salt is limited to the stage prior to the conclusion of first ripening in the emulsion-making process. In particular, the addition during the course of grain formation is preferred. The amount thereof ranges preferably from $1\times10^{-8}$ to $1\times10^{-6}$ mole per mole of silver.

Further, a water-soluble iridium salt such as $Na_3IrCl_6$, $Na_2IrCl_6$ or the like can be used. It is desirable for the iridium salt to be added before the first ripening step in the emulsion-making process. The amount thereof ranges preferably from $1\times10^{-8}$ to $1\times10^{-5}$ mole per mole of silver.

Gold sensitizers used in the present invention include various gold salts, such as potassium chloroaurite, potassium auric thiocyanate, potassium chloroaurate, auric trichloride and so on. Specific examples of gold sensitizers are disclosed in U.S. Pat. Nos. 2,399,083 and 2,642,361.

Sulfur sensitizers used in the present invention include not only the sulfur compounds contained in gelatin but also other sulfur compounds such as thiosulfates, thioureas, thiazoles, rhodanines and so on. Specific examples of sulfur sensitizers are disclosed in U.S. Pat. Nos. 1,574,944, 2,278,947, 2,410,689, 2,728,668, 3,501,313 and 3,656,955.

Sulfur compounds preferred as the sulfur sensitizer are thiosulfates and thiourea compounds.

It is desirable that each of the sulfur sensitizer and the gold sensitizer be added in an amount of $10^{-2}$ to $10^{-7}$ mole, preferably $1\times10^{-3}$ to $5\times10^{-6}$ mole, per mole of silver.

The sulfur sensitizer and the gold sensitizer are added in a ratio of 1:3 to 3:1, preferably 1:2 to 2:1, by mole.

Also, reduction sensitization can be employed in the present invention.

Suitable examples of a reduction sensitizer suitable herein include stannous salts, amines, formamidine sulfinic acid, silane compounds and so on.

The temperature at which the chemical sensitization is carried out in the present invention ranges from 30° C. to 90° C. In carrying out the chemical sensitization, the pH of the emulsion is adjusted to the range of 4.5 to 8.5, preferably 5.0 to 7.0. The chemical sensitization time cannot be fixed absolutely since it depends on the temperature at which the chemical sensitization is carried out, the amounts of chemical sensitizers used, the pH of the emulsion to undergo chemical sensitization and so on. Though the chemical sensitization time can be chosen from a wide range of several minutes to several hours, it ranges generally from 10 to 200 minutes.

When a silver halide emulsion is spectrally sensitized in the infrared region, it sometimes occurs that the emulsion in a sol state becomes unstable. In order to prevent this phenomenon, it is effective to add a water-soluble bromide to the emulsion. As for the water-soluble bromide, various compounds which can be dissociated in water to yield bromine ion can be used. Suitable examples of such bromides include ammonium bromide, potassium bromide, sodium bromide, lithium bromide and the like. In addition, proper organic bromides such as tetraethylammonium bromide, ethylpyridinium bromide and the like may be employed. The above-cited bromides are preferable to cadmium bromide, zinc bromide and the like, since the latter are detrimental when absorbed to too great an extent into the human body.

The water-soluble bromide is added to the emulsion in an amount sufficient to substantially increase the sensitivity of the emulsion and/or to substantially prevent the sensitivity from changing with time. Although the addition amount can be varied over a wide range, a satisfactory result can be obtained especially when the bromide is added in an amount ranging from 0.0003 to 0.01 mole per mole of silver. A more satisfactory result can be obtained when the addition amount ranges from 0.0005 to 0.005 mole per mole of silver. When the anion of the sensitizing dye used is bromine or bromide, the sum of the amount of the water-soluble bromide and that of the anion of the sensitizing dye corresponds to the above-described range.

The addition time of the water-soluble bromides may be at any stage after the formation of silver halide grains, preferably after the conclusion of chemical sensitization.

The sensitizing dyes according to the present invention can be used together with other sensitizing dyes. Suitable examples of such dyes include those disclosed in U.S. Pat. Nos. 3,703,377, 2,688,545, 3,397,060, 3,615,635 and 3,628,964, British Patents 1,242,588 and 1,293,862, JP-B-43-4936, JP-B-44-14030, JP-B-43-10773, U.S. Pat. No. 3,416,927, JP-B-43-4930, and U.S. Pat. Nos. 3,615,613, 3,615,632, 3,617,295 and 3,635,721.

The photographic emulsions used in the present invention can contain a wide variety of compounds for the purpose of preventing the sensitivity from lowering and the fog from generating during production, storage or photographic processing. As for the compounds which can satisfy the above-described purpose, a great number of compounds including nitrobenzimidazole, ammonium chloroplatinate, 4-hydroxy-6-methyl-1,3,3a,7-tetraazaindene, 1-phenyl-5-mercaptotetrazole, many other heterocyclic compounds, mercury-containing compounds, mercapto compounds and metal salts, are known from old times. More specifically, one can use the compounds described in *The Theory of the Photographic Process*, 3rd Ed., edited by C. E. K. Mees, at pages 344 to 349 (1966), wherein their respective references are given; the thiazolium salts disclosed, e.g., in U.S. Pat. Nos. 2,131,038 and 2,694,716; the azaindenes disclosed, e.g., in U.S. Pat. Nos. 2,886,437 and 2,444,605; the urazoles disclosed, e.g., in U.S. Pat. No. 3,287,135; the sulfocatechols disclosed, e.g., in U.S. Pat. No. 3,236,652; the oximes disclosed, e.g., in British Patent 623,448; the mercaptotetrazoles disclosed, e.g., in U.S. Pat. Nos. 2,403,927, 3,266,897 and 3,397,987; nitron; nitroindazoles; the polyvalent metal salts disclosed, e.g., in U.S. Pat. No. 2,839,405; the thiuronium salts disclosed, e.g., in U.S. Pat. No. 3,220,839; the palladium salts, the platinum salts and the gold salts disclosed, e.g., in U.S. Pat. Nos. 2,566,263 and 2,597,915; and so on.

The silver halide photographic emulsions can contain a developing agent, e.g., one selected from hydroquinones, catechols, aminophenols, 3-pyrazolidones, ascorbic acid and its derivatives, reductones or phenylenediamines, or a combination of two or more of the developing agents cited above. The developing agent can be incorporated into a silver halide emulsion layer and/or another photographic constituent layer (e.g., a protective layer, an intermediate layer, a filter layer, an antihalation layer, a backing layer). The incorporation into such a layer can be carried out in a condition such that it is dissolved in an appropriate solvent or dispersed in accordance with U.S. Pat. No. 2,592,368 or French Patent 1,505,778.

As the development accelerator, the compounds disclosed, e.g., in U.S. Pat. Nos. 3,288,612, 3,333,959, 3,345,175 and 3,708,303, British Patent 1,098,748, and West German Patents 1,141,531 and 1,183,784 can be used.

The photographic emulsions of the present invention can contain an inorganic or organic hardener. For instance, chromium salts (such as chrome alum, chromium acetate), aldehydes (such as formaldehyde, glyoxal, glutaraldehyde), N-methylol compounds (such as dimethylolurea, methyloldimethylhydantoin), dioxane derivatives (such as 2,3-dihydroxydioxane), active vinyl compounds (such as 1,3,5-triacryloyl-hexahydro-s-triazine, bis-(vinylsulfonyl)methyl ether, N,N'-methylene-bis-[β-vinylsulfonyl)propionamide]), active halogen-containing compounds (such as 2,4-dichloro-6-hydroxy-s-triazine), mucohalogens (such as mucochloric acid, mucophenoxychloric acid), isooxazoles, dialdehyde starch, 2-chloro-6-hydroxytriazinylated gelatin and so on can be used alone or as a mixture of two or more thereof. Specific examples of such hardeners are disclosed in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Patent 676,628, 826,544 and 1,270,578, German Patents 872,153 and 1,090,427, JP-B-34-7133, JP-B-46-1872, and so on.

The photographic emulsion layers and other hydrophilic colloid layers which constitute the photographic material prepared in accordance with the present invention may contain various kinds of surfactants for a wide variety of purposes, for instance, as a coating aid, for static charge prevention, improvement in slippability, dispersion in the form of an emulsion, blocking prevention and improvement in photographic characteristics (e.g., acceleration of development, increase in contrast, sensitization).

Suitable examples of surfactants which can be used include nonionic surfactants such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamine or amides, polyethylene oxide adducts of silicone), glycidol derivatives (e.g., alkenylsuccinic acid glyceride, alkylphenol polyglyceride), fatty acid esters of polyhydric alcohols, alkyl esters of sugars, and so on; anionic surfactants containing acid groups such as a carboxyl group, a sulfo group, a phospho group, a sulfate group, a phosphate group, etc., for example, alkyl carboxylates, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkylpolyoxyethylene alkyl phenyl ethers, polyoxyethylene alkylphosphoric acid esters and so on; amphoteric surfactants such as amino acids, aminoalkylsulfonic acids, aminoalkylsulfuric acid or phosphoric acid esters, alkylbetaines, amine oxides and so on; and cationic surfactants such as alkylamine salts, aliphatic or aromatic quaternary ammonium salts, heterocyclic quaternary ammonium salts such as pyridinium, imidazolium and like salts, aliphatic or heterocyclic phosphonium or sulfonium salts, and so on.

For the purpose of making the characteristic curve rise sharply in the toe portion, e.g., to obtain halftone or line images of high quality, one can use polyalkylene oxide compounds (such as a condensate of a polyalkylene oxide constituted of at least 10 units of alkylene oxide containing 2 to 4 carbon atoms, e.g., ethylene oxide, propylene-1,2-oxide or butylene-1,2-oxide, preferably ethylene oxide, and a compound having at least one active hydrogen, e.g., water, an aliphatic alcohol, an aromatic alcohol, a fatty acid, an organic amine or a hexitol derivative; a block copolymer of two or more kinds of polyalkylene oxides; etc.). Specific examples of such polyalkylene oxide compounds include those disclosed in JP-A-50-156423, JP-A-52-108130 and JP-A-53-3217. These polyalkylene oxide compounds may be used individually or as mixture of two or more thereof.

As the binder or the protective colloid of the photographic emulsions, gelatin is used to advantage. Of course, other hydrophilic colloids can be also used. Specific examples of hydrophilic colloids which can be used include proteins such as gelatin derivatives, graft copolymers prepared from gelatin and other high polymers, albumin, casein, etc.; sugar derivatives such as cellulose derivatives (e.g., hydroxyethyl cellulose, carboxymethyl cellulose, cellulose sulfate), sodium alginate, starch derivatives, etc.; and various kinds of synthetic hydrophilic macromolecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and the like.

As the gelatin, not only lime-processed gelatin, but also acid-processed gelatin, may be used. In addition, hydrolysis products of gelatin and enzymatic degradation products of gelatin can also be used. As the gelatin derivatives, one can use those obtained by reaction of gelatin with various kinds of compounds such as acid halides, acid anhydrides, isocyanates, bromoacetic acid, alkanesultones, vinylsulfonamides, maleimide compounds, polyalkylene oxides, epoxy compounds and so on. Specific examples of such derivatives include the compounds disclosed in U.S. Pat. Nos. 2,614,928, 3,132,945, 3,186,846 and 3,312,553, British Patents 861,414, 1,033,189 and 1,005,784, JP-B-42-26845, and so on.

The photographic emulsions of the present invention can contain a water insoluble or slightly soluble synthetic polymer dispersion for the purpose of improvement in dimensional stability and so on. Polymers suitable for this purpose include those containing as a monomer component, an alkyl (meth)acrylate, an alkoxyacryl (meth)acrylate, a glycidyl (meth)acrylate, a (meth)acrylamide, a vinyl ester (e.g., vinyl acetate), an acrylonitrile, an olefin and a styrene independently or in combination of two or more thereof; and copolymers containing as monomer component a combination of one or more of the above-cited monomers with at least one monomer selected from among acrylic acids, methacrylic acids, $\alpha,\beta$-unsaturated dicarboxylic acids, hydroxyalkyl (meth)acrylates, sulfoalkyl (meth)acrylates and styrene-sulfonic acids.

The photographic material of the present invention may be processed by any conventional photographic processing method.

As the developing agent in a developer, those of the dihydroxybenzene type, the 1-phenyl-3-pyrazolidone type and the p-aminophenol type can be used alone or in combination (for instance, combinations of 1-phenyl-3-pyrazolidones with dihydroxybenzenes and combinations of p-aminophenols with dihydroxybenzenes can be used). Also, the photographic material of the present invention may be processed with the so-called infectious developer using a combination of a sulfite ion buffer, such as carbonylbisulfite, with hydroquinone.

As the developing agent of the dihydroxybenzene type, hydroquinone, chlorohydroquinone, bromohydroquinone, isopropylhydroquinone, toluhydroquinone, methylhydroquinone, 2,3-dichlorohydroquinone and 2,5-dimethylhydroquinone are examples thereof. As the developing agent of the 1-phenyl-3-pyrazolidone type, 1-phenyl-3-pyrazolidone, 4,4-dimethyl-1-phenyl-3-pyrazolidone, 4-hydroxymethyl-4-methyl-1-phenyl-3-pyrazolidone and 4,4-dihydroxymethyl-1-phenyl-3-pyrazolidone are examples thereof. As the developing agent of the p-aminophenol, type, p-aminophenol and N-methyl-p-aminophenol are examples thereof.

To the developer can be added as a preservative a compound which is capable of providing a free sulfite ion, such as sodium sulfite, potassium sulfite, potassium metabisulfite, sodium bisulfite and the like. In case of the infectious developer, formaldehyde sodium bisulfite which hardly provides free sulfite ion in the developer may be used.

Suitable alkali agents for the developer used in the present invention include potassium hydroxide, sodium hydroxide, potassium carbonate, sodium carbonate, sodium acetate, potassium tertiary phosphate, diethanolamine, triethanolamine and so on. The pH of the developer is generally adjusted to 9 or higher, preferably 9.7 or higher.

The developer may contain organic compounds known as an antifoggant or a development inhibitor. Specific examples of such organic compounds include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines; thioketo compounds such as oxazolinethione; azaindenes such as triazaindenes, tetraazaindenes (especially 4-hydroxy substituted (1,3,3a,7)tetrazaindenes), pentaazaindenes and the like; as well as benzenethiosulfonic acid, benzenesulfinic acid, benzenesulfonic acid amide and sodium 2-mercaptobenzimidazole-5-sulfonate.

The developer used in the present invention may contain as a development inhibitor the polyalkylene oxides similar to those described hereinbefore. More specifically, polyethylene oxides having a molecular weight within the range of 1,000 to 10,000 can be added to the developer in an amount of 0.1 to 10 g/l.

Further, it is desirable for the developer in the present invention to contain as a water softener nitrilotriacetic acid, ethylenediamine tetraacetic acid, triethylenetetramine hexaacetic acid, diethylenetetramine pentaacetic acid or the like.

The fixer may be one of those commonly used.

The fixers can contain as a fixing agent not only a thiosulfate or a thiocyanate, but also an organic sulfur-containing compound known to be effective as a fixing agent.

The fixers may contain a water-soluble aluminum salt as a hardener.

The fixers may also contain a complex of ethylenediamine tetraacetic acid and trivalent iron ion as a sulfurizing agent.

The processing temperature and time can be chosen properly. In general, it is desirable that the processing temperature range from 18° C. to 50° C. It is preferable that a so-called rapid processing, with a processing time which ranges from 15 to 120 seconds, be performed with an automatic developing machine.

The present invention is illustrated in greater detail by reference to the following examples. However, the invention should not be construed as being limited to these examples.

EXAMPLES

Emulsions were prepared in the following manner.

To an aqueous gelatin solution containing sodium chloride, 1,3-dimethylimidazolidine-2-thione and benzenethiosulfonic acid and adjusted to pH 4.0, a 0.5M aqueous solution of silver nitrate and an aqueous halide solution containing 0.1M of potassium bromide, 0.44M of sodium chloride, potassium hexachloroiridate(III) and ammonium hexabromorhodate(III) were added over a 10-minute period at 38° C. with stirring in accordance with a double jet method to effect nucleation. Thus, silver chlorobromide grains having an average size of 0.16 μm and a chloride content of 70 mole % were obtained. Thereto, a 0.5M aqueous solution of silver nitrate and an aqueous halide solution containing 0.1M of potassium bromide, 0.44M of sodium chloride and potassium ferrocyanide were added similarly over a 10-minute period in accordance with a double jet method, resulting in the formation of the intended grains. The thus formed grains were cubic grains of silver chlorobromide which had an average grain size of 0.2 μm and a chloride content of 70 mol % and contained $3.8\times10^{-7}$ mole of iridium and $6.1\times10^{-8}$ mole of rhodium per mole of silver (variation coefficient: 10%). Thereafter, in analogy with conventional manners, the emulsion comprising the foregoing cubic grains was washed in accordance with a flocculation method, and thereto was added 30 g of gelatin.

The resulting emulsion was adjusted to pH 5.6 and pAg 7.5, and chemically sensitized by adding thereto 6.0 mg of sodium thiosulfate and 8.0 mg of chloroauric acid per mole of silver and maintaining the emulsion at 65° C. till it acquired the optimal sensitivity. Further, 75 mg of 4-hydroxy-6-methyl-1,3,3a,7-tetrazaindene was added to the emulsion as a stabilizing agent.

To the thus prepared emulsion, each of the dyes set forth in Table 1 was added in the amount shown therein. Further, the emulsion was admixed with 234 mg per mole of silver of disodium 4,4'-bis(4,6-dinaphthoxypyrimidine-2-ylamino)-stilbenedisulfonate and 25 mg per mole of silver of 1-phenyl-5-mercaptotetrazole.

Furthermore thereto were added 150 mg/m$^2$ of hydroquinone, polyethylacrylate latex in a proportion of 30% to gelatin binder, 0.01 μm-sized colloidal silica in a proportion of 30% to gelatin binder, and 70 mg/m$^2$ of 2-bis(vinylsulfonylacetamido)ethane as a hardener.

The thus obtained emulsion was coated on a polyester support so as to obtain a silver coverage of 3.2 g/m$^2$ and a gelatin coverage of 1.4 g/m$^2$. Simultaneously with the coating of the emulsion, a composition containing 0.5 g/m$^2$ of gelatin, 70 mg/m$^2$ of the dye having the following structural formula, 60 mg/m$^2$ of polymethylmethacrylate particles having a size of 2.5 μm as a matting agent, 70 mg/m$^2$ of colloidal silica having a size of 10 μm, 1.5 mg/m$^2$ of coating aids constituted of sodium dodecylbenzenesulfonate and the fluorine-containing surfactant having the formula illustrated below and 20 mg/m$^2$ of the chelating agent having the formula illustrated below, which had been adjusted to pH 5.5, was coated so as to form a protective layer on the emulsion layer.

S-1

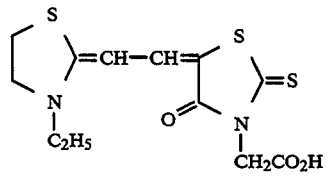

S-2

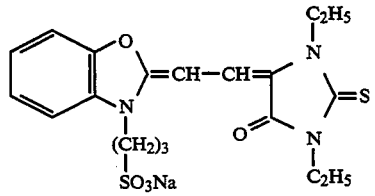

S-3

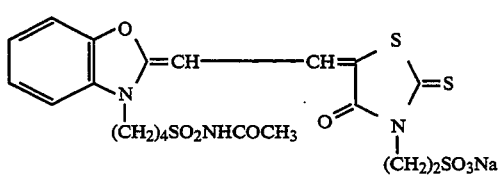

Dye

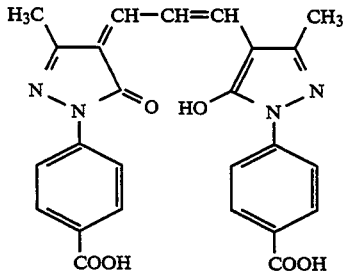

Surfactant

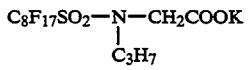

Chelating Agent

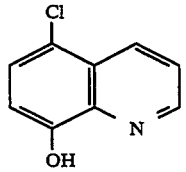

TABLE 1

| Sample No. | Dye | Amount added (mg/Kg emulsion) |
|---|---|---|
| 1 (comparison) | S-1 | 400 |
| 2 (comparison) | S-2 | 400 |
| 3 (comparison) | S-3 | 400 |
| 4 (invention) | I-6 | 400 |
| 5 (invention) | I-15 | 400 |
| 6 (invention) | I-18 | 400 |

Additionally, the polyester support used in preparing the samples had a backing layer and a back protecting layer having the following compositions respectively.

| Composition of Backing Layer: | |
|---|---|
| Gelatin | 2.0 g/m$^2$ |
| Sodium dodecylbenzenesulfonate | 80 mg/m$^2$ |

-continued

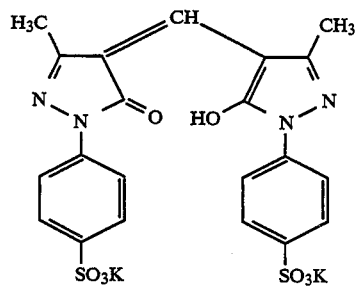

160 mg/m²

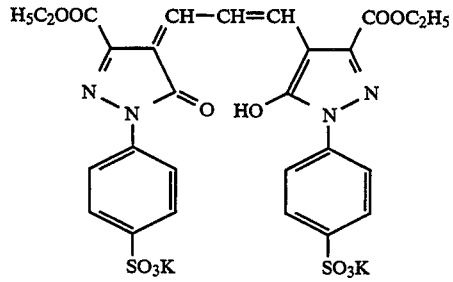

40 mg/m²

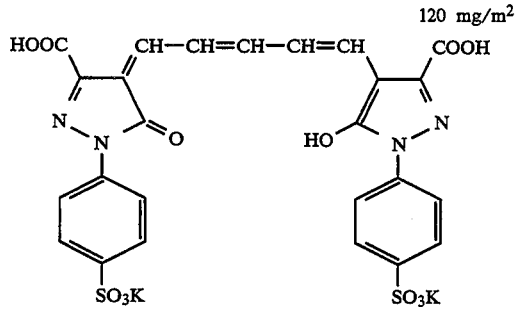

120 mg/m²

| | |
|---|---|
| 1,3-Divinylsulfone-2-propanol | 60 mg/m² |
| Composition of Back Protecting Layer: | |
| Gelatin | 0.5 g/m² |
| Polymethylmethacrylate (particle size: 4.7 μm) | 30 mg/m² |
| Sodium dodecylbenzenesulfonate | 20 mg/m² |
| Fluorine-containing surfactant (the same as used in the foregoing protective layer) | 2 mg/m² |
| Silicone oil | 100 mg/m² |

The thus prepared samples were each exposed to a xenon flash lamp having a light emission time of $10^{-5}$ second via an interference filter having its peak at 515 nm and a continuous wedge. They were then subjected to sensitometry with an automatic developing machine, Model FG-710 NH, produced by Fuji Photo Film Co., Ltd., under conditions such that the processing temperature and time were specified as follows:

| | | |
|---|---|---|
| Development | 38° C. | 14 seconds |
| Fixation | 37° C. | 9.7 seconds |
| Washing | 26° C. | 9 seconds |
| Squeeze | | 2.4 seconds |
| Drying | 55° C. | 8.3 seconds |
| Total processing time | | 43.4 seconds |
| Linear velocity | | 2,800 mm/min |

The developer and the fixer used herein had the following compositions, respectively.

| | |
|---|---|
| Developer: | |
| Potassium hydroxide | 10 g |
| Diethylenetriaminepentaacetic acid | 2.6 g |
| Potassium bromide | 3.3 g |
| 5-Methylbenzotriazole | 0.08 g |
| Sodium 2-mercaptobenzimidazole-5-sulfonate | 0.3 g |
| Potassium sulfite | 83 g |
| Hydroquinone | 35 g |
| 4-Hydroxymethyl-4-methyl-1-phenyl-3-pyrazolidone | 1.3 g |
| Diethylene glycol | 30 g |
| Water to make | 1 l |
| (The pH was adjusted to 10.7 by addition of sodium hydroxide.) | |
| Fixer: | |
| Ammonium thiosulfate | 150 g |
| 1,4,5-Trimethyl-1,2,4-triazolium-3-thiolate | 0.25 mol |
| Sodium bisulfite | 30 g |
| Disodium ethylenediaminetetraacetate dihydrate | 0.025 g |
| Water to make | 1 l |
| (The pH was adjusted to 6.0 by addition of sodium hydroxide.) | |

Evaluation of Sensitivity

The sensitivities were defined as the logarithm of an exposure amount required for providing a density of 3.0, and shown as the relative values, with Sample No. 1 being taken as ±0.

Evaluation of Residual Color

The unexposed samples were processed in the same manner as adopted in the evaluation of sensitivity, except that the temperature of the washing water was 5° C., and color remaining in each processed sample, that is, residual color was examined by visual observation. An evaluation was made by grading the extent of residual color in 5 ranks. The rank 5 means the smallest extent of residual color, the rank 1 the greatest extent of residual color, and the rank 3 the limit of practical use.

Evaluation results obtained are shown in Table 2.

TABLE 2

| Sample No. | Sensitivity | Residual Color |
|---|---|---|
| 1 (comparison) | ±0 (standard of sensitivity) | 1 |
| 2 (comparison) | +0.01 | 1 |
| 3 (comparison) | +0.02 | 1 |
| 4 (invention) | +0.05 | 5 |
| 5 (invention) | +0.05 | 4 |
| 6 (invention) | +0.05 | 5 |

As can be seen from Table 2, Sample Nos. 4, 5 and 6 prepared in accordance with the present invention are superior in both sensitivity and residual color.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a light-sensitive silver halide layer spectrally sensitized with a sensitizing dye represented by the following general formula (I):

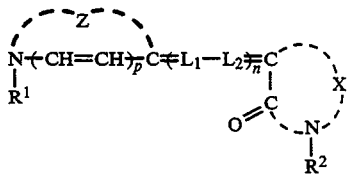

(I)

wherein Z represents nonmetal atoms necessary to complete a 5- or 6-membered heterocyclic ring; X represents non-metal atoms necessary to complete a 5- or 6-membered acidic nucleus; $R^2$ represents $—(CH_2)_r—CONHSO_2—R^3$, $—(CH_2)_s—SO_2NHCO—R^4$, $—(CH_2)_t—CONHCO—R^5$ or $—(CH_2)_u—SO_2NHSO_2—R^6$; $R^3$, $R^4$, $R^5$ and $R^6$ each represent an alkyl group, an alkoxy group or an amino group; r, s, t and u each represent an integer from 1 to 5; $R^1$ has the same meaning as $R^2$ or represents an alkyl group substituted by a sulfo or carboxyl group; p represents 0 or 1; $L_1$ and $L_2$ each represent a methine group; and n represents 0, 1, 2 or 3.

2. The photographic material of claim 1, wherein $R^2$ represents $—(CH_2)_r—CONHSO_2—R^3$, r represents an integer from 1-5, and $R^3$ represents an alkyl, an alkoxy group or an amino group.

3. The photographic material of claim 1, wherein $R^2$ represents $—(CH_2)_s—SO_2NHCO—R^4$, s represents an integer from 1-5, and $R^4$ represents an alkyl, an alkoxy group or an amino group.

4. The photographic material of claim 1, wherein $R^2$ represents $—(CH_2)_t—CONHCO—R^5$, t represents an integer from 1-5, and $R^5$ represents an alkyl, an alkoxy group or an amino group.

5. The photographic material of claim 1, wherein $R^2$ represents $—(CH_2)_u—SO_2NHSO_2—R^6$, u represents an integer from 1-5, and $R^6$ represents an alkyl, an alkoxy group or an amino group.

6. The photographic material of claim 1, wherein $R^1$ represents an alkyl group substituted by a sulfo group.

7. The photographic material of claim 6, wherein the alkyl group substituted by a sulfo group is 2-sulfoethyl, 3-sulfopropyl or 4-sulfobutyl.

8. The photographic material of claim 1, wherein $R^1$ represents an alkyl group substituted by a carboxyl group.

9. The photographic material of claim 8, wherein the alkyl group substituted by a carboxyl group is carboxymethyl, 2-carboxyethyl or 3-carboxybutyl.

* * * * *